United States Patent [19]

Olszewski et al.

[11] 4,085,284

[45] Apr. 18, 1978

[54] D-SHIELD TELEPHONE CABLES

[75] Inventors: Jerzy A. Olszewski, Edison; Ludwig Jachimowicz, Elizabeth, both of N.J.

[73] Assignee: General Cable Corporation, Boonton, N.J.

[21] Appl. No.: 713,228

[22] Filed: Aug. 10, 1976

[51] Int. Cl.[2] ..... H01B 11/06

[52] U.S. Cl. ..... 174/36; 174/106 R; 174/107

[58] Field of Search ..... 174/36, 105 R, 105 B, 174/103, 106 R, 113 R, 27, 107

[56] References Cited

U.S. PATENT DOCUMENTS

| | | | |
|---|---|---|---|
| 3,622,683 | 11/1971 | Roberts et al. | 174/36 |
| 3,803,340 | 4/1974 | Jachimowicz et al. | 174/36 |
| 3,911,200 | 10/1975 | Simons et al. | 174/36 |
| 3,968,321 | 7/1976 | Olszewski et al. | 174/36 |

FOREIGN PATENT DOCUMENTS

| | | | |
|---|---|---|---|
| 953,384 | 8/1974 | Canada | 174/36 |
| 118,147 | 2/1930 | Germany | 174/36 |
| 78,635 | 10/1933 | Sweden | 174/36 |
| 492,333 | 9/1938 | United Kingdom | 174/36 |

*Primary Examiner*—Arthur T. Grimley
*Attorney, Agent, or Firm*—Roy C. Hopgood; John M. Calimafde; Charles W. Neill

[57] ABSTRACT

This internally shielded telephone cable provides more efficient shielding for meeting near-end crosstalk requirements in carrier systems having expanded channel capacity and increase in equivalent frequency from 772 kHz to 1.576 MHz or higher. The improved shielding uses tapes bent into configurations that obtain greater shielding area from a single tape, and constructions that are less expensive than prior art and produce a mechanically stronger and more unitary cable structure.

17 Claims, 6 Drawing Figures

14
12
10
20
16
22
18

28
30
26
32
34
36
38
44
42
40

46
30'
34'
28'
32'
50
48
40'

62
54
28a
32a
30a
34a
56
66
6
58
60
40a 36
70
70

40a
32a
6
58
28a

D-SHIELD TELEPHONE CABLES

RELATED PATENT

This invention is an improvement on the construction disclosed in U.S. Pat. No. 3,803,340, issued Apr. 9, 1974.

BACKGROUND AND SUMMARY OF THE INVENTION

Continued expansion of channel capacity increases frequency bandwidth and thus necessitates improvement in shielding efficiency. The recent development of 48 channel PCM carrier system (Tl-C) and consequently increase in the equivalent frequency from 772 kHz to 1.576 MHz put additional demand on shielding efficiency of the internal shield. The near-end crosstalk requirements were tentatively established at 80dB worst case power sun, and our design per U.S. Pat. No. 3,803,340 was found to be marginal in performance, especiall in small pair count cables.

The improved shields require the use of more metal for shielding and necessitate changes in the method by which the cables are manufactured, but by novel configuarations of the shields, some of the cost of added material can be offset by more efficient use of the shield areas and the mechanical strength of the cables can be increased to withstand better the rigors of installation.

Internally shielded cables should be competitive cost-wise with the two separate cable approach; that is, each standard cable used for a different direction of transmission. The preferred embodiments of this invention are more economical than the use of different cables for each direction of transmission of signals. Shielded telephone cables are normally buried, and consequently their overall shields are used for lightning protection.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENTS

Figures 1, 2, 3, 4, 5, 6:
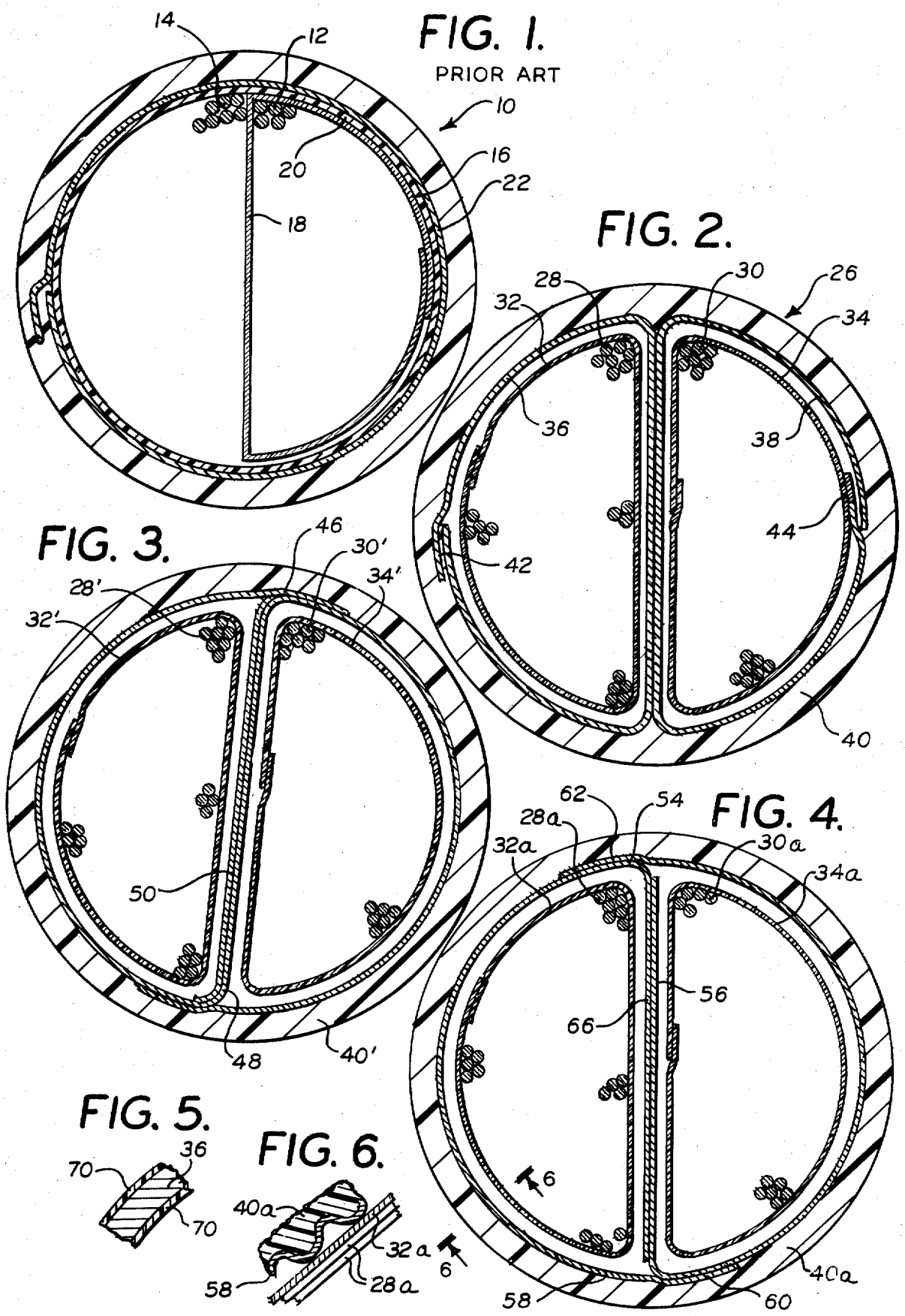
FIG. 1. PRIOR ART
FIG. 1 is a diagrammatic cross-sectional view of a shielded cable such as shown in our patent referred to above.
FIG. 2 is a diagrammatic cross-section of a cable having more shielding and constructed to meet the more exacting requirements of present telephone transmission practices.
FIGS. 3 and 4 show modifications of the construction shown in FIG. 2 and illustrate the preferred embodiments of this invention.
FIG. 5 is a greatly enlarged, fragmentary sectional view showing the metal shielding with corrosion protecting coating on both sides.
FIG. 6 is an enlarged fragmentary sectional view taken on the lines 6—6 of FIG. 4.

FIG. 1 shows the prior art in which a cable 10 has two groups of conductors for carrying the messages in opposite directions. One group is designated by the reference character 12, and the other group by the reference character 14. The group 12 is enclosed in a metal shield or screen 16 having a diametral portion 18 which shields the group of conductors 12 from the conductors 14 of the other group. A core wrap 20 passes around both groups 12 and 14 to hold them together and to serve as a dielectric spacer between the conductors 12 and 14 and an outer shield 22.

This core wrap 20 also spaces the shield 16 from the outer shield 22. This construction of FIG. 1 represents the prior art, such as that in our U.S. Pat. No. 3,803,340, previously referred to.

FIG. 2 shows a telephone cable 26 which has conductors 28 for transmitting messages in one direction, and conductors 30 for transmitting signals in the other direction. These groups of conductors 28 and 30 are each of generally semi-circular cross-section, and the conductors of each group are bound together by a plastic core wrap 32 around the conductors 28, and a separate core wrap 34 around the conductors 30. These core wraps are preferably plastic tapes.

Beyond the core wraps 32 and 34, there are metal shields 36 and 38, respectively, which are preferably corrugated and in contact with the core wraps 32 and 34, respectively.

This shielding 36 and 38 serves the dual purpose of improved isolation between directions of transmission as well as lightning protection. Its conductivity is made equivalent to standard 8 mil thick overall aluminum shielding by suitable selection of thickness and length of overlaps. Both shields 36 and 38 are of the type having the aluminum surface coated on both sides with acrylic acid copolymer polyethylene, and are made to adhere to each other along the portions of the shields 36 and 38 which extend across the diameter of the cable in contact with one another. This adhesion is obtained from a separate laminating operation or by the heat which is present when a plastic jacket 40 is extruded over the entire circumferential surfaces of the shields 36 and 38. The outer jacket 40 also adheres to the outside surfaces of the shields 36 and 38.

The adhesion between the confronting diametral portions of the shields 36 and 38 is very important in providing the cable with mechanical strength, since it secures the opposite halves of the cable core together and results in a unibody construction of the cable core. This prevents possible distortion and damage of the cable during installation.

Another advantage in bonding the confronting faces of the shields 36 and 38 to one another is that it eliminates a possible water channel between the shields.

FIG. 3 shows a modified construction and parts in FIG. 3 which correspond to those in FIG. 2 are indicated by the same reference character with a prime appended. Instead of two shields 36 and 38, each with its own lap seam 42 and 44, respectively, the construction shown in FIG. 3 has the shields around the different groups of conductors formed from a single tape.

This tape shield, designated by the reference character 46, extends from a location near the top of the group of conductors 30′, and around the circumferential portion of the group of conductors 28′ to a location at the bottom of the group 28′. At this location, designated by the reference character 48, the tape 46 is bent so as to extend upwardly between the confronting, generally flat faces of the groups of conductors 28′ and 30′. As the tape shield 46 extends upwardly to the upper end of the group of conductors 30′, it approaches its starting location and then bends to the right in FIG. 3 and extends for a short distance in contact with the beginning of this tape 46.

After passing beyond the beginning of the tape 46, it extends circumferentially around the arcuate part of the group of conductors 30' until it overlaps for a short distance in contact with the circumferential portion of its width, which extends downward around the left-hand side of the group of conductors 28'.

Both ends of the tape 46 are preferably bonded to the portions of its length which the ends overlap so as to brace the tape shield 46 against distortion, particularly at its longitudinal edges and at its flat portion which extends between the groups of conductors 28' and 30'. In order to further strengthen this flat portion of the tape shield 46, a flat reinforcing tape 50 may be optionally bonded to the flat portion of the tape 46, so as to give the tape 46, in effect, increased thickness and greater stiffness over the flat area. If the tape 50 is of the same thickness as the tape 46, then the straight flat portion of shielding between the groups of conductors 28' and 30' is twice as thick as the curved portions of the tape shield 46; and this provides greatly increased cross-talk isolations as well as strength in a diametral plane without impairing the flexibility of the cable in directions transverse to this plane. The confronting faces of the tape 50 and the flat portion of the tape 46 are bonded together, as in FIG. 2.

FIG. 4 shows another modified construction, in which two tapes are used and they are bonded to one another at locations other than the confronting flat faces between the two groups of conductors. Parts in FIG. 4 corresponding to those in FIG. 2 are indicated by the same reference characters with a letter "*a*" appended. A shielding tape 54 starts at the upper end of the group of conductors **28*a* and extends around the cylindrical portion of the group of conductors 30*a*, and then upwardly between the two groups of conductors to form a portion 56 of the shield 54; and the upper end of this portion 56 does not connect with the rest of the tape 54**.

Another tape shield 58 has one end bonded to the tape 54 at a location 60 near the bottom of the cable. This tape shield 58 then extends to the left, in FIG. 4, around the curved side of the group of conductors **28*a* to the top of the cable where the shield 58 is bonded to the shield 54 at a location 62. By bonding the tapes 54 and 58 to one another across the entire areas of the portions 56 and 66; and by bonding the edge of each tape to a portion of the other tape across their lapped areas, the opposite halves of the cable core are firmly secured together to provide a unitary structure, and the procedure for manufacturing the cable is facilitated as compared with the construction shown in FIG. 3**.

The shielding tape of FIGS. 3 and 4 can consist of a suitable thickness of metal of a single tape and this approach eliminates the necessity of laminating two tapes along the diameter portion of the cable assembly. The industry requirement for a shielding tape, which extends circumferentially around a communication cable, is that the shield be 8 mils in thickness. This invention uses wider tape which has a total width greater than the circumference of the cable core; and the same total cross-section can be obtained with thinner tape. In other words, the thickness of the tape of this invention is chosen so that the total cross-section of the wider tape is equal to the cross-section of an 8 mil circumferential tape.

FIG. 5 is a detail sectional view showing the shield 36 with the corrosion protecting coating 70 adhered to the opposite faces of the tape shield 36. This is the preferred construction of the shields in all of the other figures.

FIG. 6 shows the circumferentially corrugated shield 58 with its inner lobes in contact with the core wrap **32*a*, and its outer surface in contact with the extruded jacket 40*a***.

A number of constructions have been shown and described. Those shown in FIGS. 3 and 4 are the preferred embodiment of the invention. Changes and modifications can be made in the illustrated construction without departing from the invention as defined in the claims.

What is claimed is:

1. A communication cable which has two cable cores, each of which transmits messages in a different direction and each of which includes a plurality of insulated conductors bound together in a unit by a core wrap, metal shielding around each of the individual cores with a portion of the shielding extending between the cores to shield them from each other, characterized by the metal shielding including a shield around each core unit spaced from all of the conductors of the core unit by the core wrap being interposed between inside surface of the metal shield and the conductors of the corresponding core unit, each of the metal shields surrounding its own individual core unit and having an area that confronts and contacts with a part of the metal shield of the other core unit and that is bonded thereto.

2. The communication cable described in claim 1 characterized by the cable being of generally circular cross-section, and each core having a portion that extends circumferentially around a part of the circumference of the cable, and another part that extends in a generally radial direction, each core having its own metal shield completely surrounding the core and having its radially extending part confronting a corresponding part of the other core and bonded to said corresponding part of the other core to make the cable a unitary structure.

3. The communication cable described in claim 2 characterized by the metal shields being made of aluminum with a corrosion-protecting coating thereon, and the shields being bonded together by a fusion bond between the protecting coatings on the respective shields.

4. The communication cable described in claim 2 characterized by the metal shields being longitudinally folded metal tapes with seams extending along a portion of the shield which is of circumferential extent.

5. The communication cable described in claim 4 characterized by each of the metal shields being made of aluminum of a thickness as great as 8 mils and the seam being a lap seam.

6. The communication cable described in claim 4 characterized by a plastic outer jacket hugging the circumferential parts of the shields and holding the seams closed.

7. The communication cable described in claim 1 characterized by the shielding having a radially extending part that extends between adjacent cores to shield them from one another, and the radially extending part of the shielding extending continuously from its opposite ends circumferentially in opposite directions around the cores that it extends between to complete the shields of the cores.

8. The communication cable described in claim 1 characterized by the shields around the cores each having its own circumferentially extending part, but said shields having a common part that extends between the cores to shield them from one another.

9. The communication cable described in claim 7 characterized by the shielding being a single tape, and each of the circumferentially extending parts of the shielding extending circumferentially around its core until it reaches to and overlaps beyond the location where the other circumferentially extending part merges with the radially extending part of the shielding, and each overlap being bonded to the other part of the shielding that it overlaps, whereby both cores are shielded by the folding of a single longitudinal tape.

10. The communication cable described in claim 9 characterized by the sheilding including an additional part that covers the common part that extends between the cores, and that provides a laminate connected to said common part for increasing the thickness of the shielding between the cores.

11. The communication cable described in claim 1 characterized by each of the shields having a radially extending part that extends between the cores and that terminates at one end near the end of a radially extending surface of its core, and that bends at its other end in a direction to extend circumferentially around a corresponding part of the core that has a circumferential extent, the circumferentially extending part of the shield extending past said one side of the shield and beyond said one end to overlap a circumferentially extending part of the shield of the next core, the overlap being bonded to a confronting area of said next core to give the shielding a unitary structure.

12. The communication cable described in claim 11 characterized by both of the shields having radially extending parts that confront one another to provide a double thickness of shielding between the cores, said confronting parts being in contact with one another.

13. The communication cable described in claim 12 characterized by the confronting parts providing a laminated structure between the cores.

14. The communication cable described in claim 11 characterized by each shield being a metal tape folded longitudinally to conform to the shape of the cores that it surrounds, each tape being made of aluminum and of a thickness up to approximately 8 mils.

15. The communication cable described in claim 1 characterized by the shielding being transversely corrugated to increase the flexibility of the cable.

16. A communication cable which has two segmental cable cores, each of which transmits messages in a different direction and each of which includes a plurality of insulated conductors bound together in a unit by a core wrap and a one-piece metal shield that surrounds and provides lightning protection for the conductors and that also extends between said cores to provide isolation of both directions of transmission from one another, part of the shield that surrounds one of the cable cores being bonded to part of the shield that surrounds the other core.

17. The method of making a communication cable that has different cores, each containing a plurality of conductors for carrying signals in different directions, and with the cores shielded from one another and from the surrounding environment, which method comprises wrapping the cores with plastic core wraps to hold the conductors assembled together, longitudinally folding a metal shielding tape around each core outside of the plastic wrap, shaping the shielding so that areas of the shielding for one core confront areas of the shielding for the other core and bonding the confronting areas to one another to make the shielding a unitary structure.

* * * * *

UNITED STATES PATENT OFFICE

CERTIFICATE OF CORRECTION

Patent No. 4,085,284 Dated April 18, 1978

Inventor(s) JERZY A. OLSZEWSKI & LUDWIG JACHIMOWICZ

It is certified that error appears in the above-identified patent and that said Letters Patent are hereby corrected as shown below:

The address of the assignee is Greenwich, Connecticut

Signed and Sealed this

*Twelfth* Day of *September 19*

[SEAL]

*Attest:*

RUTH C. MASON
*Attesting Officer*

DONALD W. BANNER
*Commissioner of Patents and Trademark*